US006401822B1

(12) United States Patent
Baugh

(10) Patent No.: US 6,401,822 B1
(45) Date of Patent: Jun. 11, 2002

(54) FLOAT VALVE ASSEMBLY FOR DOWNHOLE TUBULARS

(75) Inventor: John L. Baugh, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/602,326

(22) Filed: Jun. 23, 2000

(51) Int. Cl.[7] ..... E21B 34/08
(52) U.S. Cl. ..... 166/319; 166/154; 166/156
(58) Field of Search ..... 166/153, 156, 166/177.4, 386, 192, 196, 193, 154, 319, 373, 374

(56) References Cited

U.S. PATENT DOCUMENTS 4,042,014 A * 8/1977 Scott ..... 166/367
4,372,390 A * 2/1983 Baugh et al. ..... 166/373
4,694,903 A * 9/1987 Ringgenberg ..... 166/250
4,800,969 A 1/1989 Thompson
4,898,243 A * 2/1990 Lindsey et al. ..... 166/290
5,062,481 A * 11/1991 Gullett ..... 166/153
5,392,852 A * 2/1995 Laurel et al. ..... 166/153

FOREIGN PATENT DOCUMENTS

GB 2147642 A 5/1985
GB 2311314 A 9/1997

* cited by examiner

*Primary Examiner*—Frank Tsay
(74) *Attorney, Agent, or Firm*—Steve Rosenblatt

(57) ABSTRACT

A check valve assembly for the bottom of a casing string with increased open area is provided. Multiple check valves are provided for assurance of ultimate closure. Bypass flow paths are available during run in that increase the normal available open area from about 3 square inches to a range of about 10 square inches and even higher. Components freely float during run in to provide the greater open area and are subsequently repositioned with known techniques of dropping a ball and pressurization when the casing has reached the desired depth.

19 Claims, 4 Drawing Sheets

FLOAT VALVE ASSEMBLY FOR DOWNHOLE TUBULARS

FIELD OF THE INVENTION

The field of the invention relates to float valves for use in running casing into wellbores or running other downhole tools into a wellbore with close clearances at higher speeds.

BACKGROUND OF THE INVENTION

Rig time is costly to well owners and operators. One way to cut down on rig time is to be able to increase the rate at which casing is run into a wellbore. Casing normally includes a check valve near its lower end. This valve can be locked open during running to allow fluid entry inside of the casing. This check valve contains a fairly small open area in the order of approximately 3 square inches when casing in the order of 9⅝ to 13⅜ inches in diameter is being run. The small opening size in this check valve limits the rate of advancement of the casing into the wellbore. An overly aggressive advancement rate results in undesirable fluid pressure buildup on the formation adversely affecting well control and future productivity of the formation.

Another typical choke point apart from the check valve at the bottom of a casing string is through the wiper plug near the top of the casing when it is being run in. Typically the cross sectional area in the flow bore through the wiper plug assembly is in the order of about 3 square inches.

Accordingly, it is an object of the present invention to optimize the available open area during run in to allow higher running rates for the casing. The apparatus of the present invention is useful not only in running casing but can also be useful in running downhole tools in wellbores with fairly low clearances.

SUMMARY OF THE INVENTION

A check valve assembly for the bottom of a casing string with increased open area is provided. Multiple check valves are provided for assurance of ultimate closure. Bypass flow paths in the area of the check valve and the wiper plug are available during run in that increase the normal available open area from about 3 square inches to a range of about 10 square inches and even higher. Components freely float during run in to provide the greater open area and are subsequently repositioned with known techniques of dropping a ball and pressurization when the casing has reached the desired depth.

BRIEF DESCRIPTION OF THE DRAWINGS

FIGS. 1*a–d* illustrate a section view of the apparatus of the present invention during run in;

FIGS. 2*a–d* illustrate a section view of the apparatus of the present invention when the desired depth is reached; and FIGS. 3*a–d* illustrate a section view of the apparatus of the present invention in a condition ready for cementing.

DETAILED DESCRIPTION OF THE PREFERRED EMBODIMENT

Figure 1A:
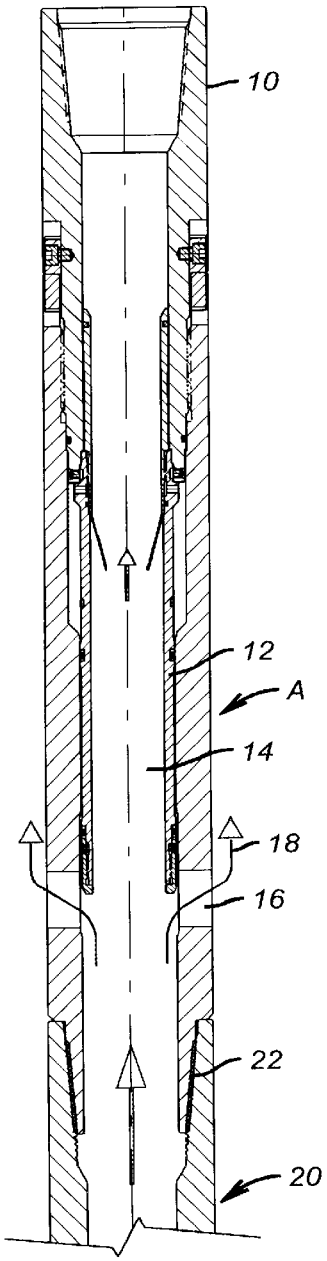
Figure 2A:
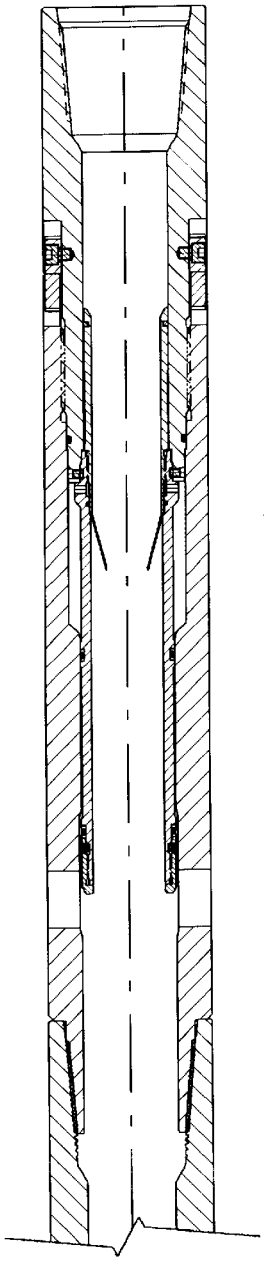
Figure 3A:
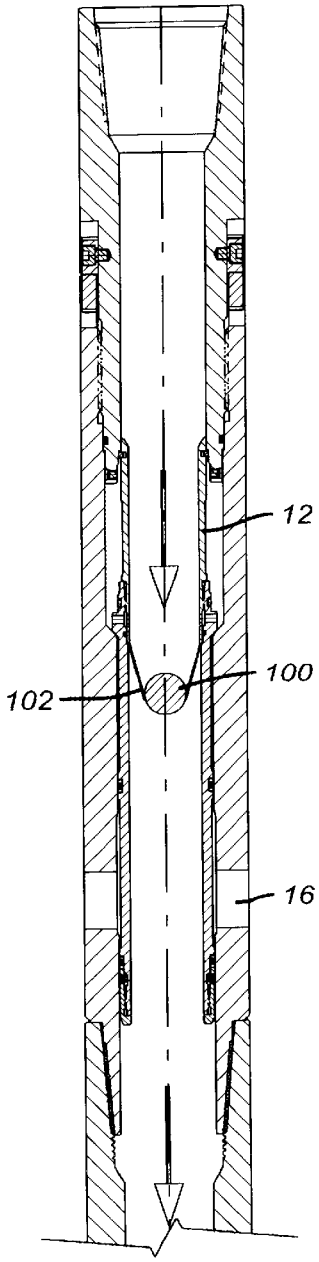

The apparatus A of the present invention is shown in FIGS. 1*a–d*. A valve 10 has a sliding sleeve 12 within bore 14. In the run in position the ports 16 are in the open position to allow flow represented by arrow 18 to run through them as the apparatus A is advanced. A running tool 20 is connected to top sub 10 at thread 22. The running tool 20 is a known design and it is connected to the casing 24 by a series of collets 26 locked into a groove 28. The liner wiper plug is connected to a seal extension 30 from the setting tool by shear screws 5.

The liner wiper plug 46 has an inner mandrel 40 with ports 32. A floating sleeve or moveable component 34 is shown in its uppermost position such that ports 36 on floating sleeve 34 line up with ports 32 on the inner mandrel 40. Flow represented by arrow 38 can go through these aligned ports. Floating sleeve 34 sits in a receptacle or stationary component 40 which has openings 42 to allow flow to go through them as represented by arrow 44.

The wiper plug 46 is a known construction with the addition of a floating sleeve 34 and the receptacle 40.

Figures 1B, 2B, 3B:
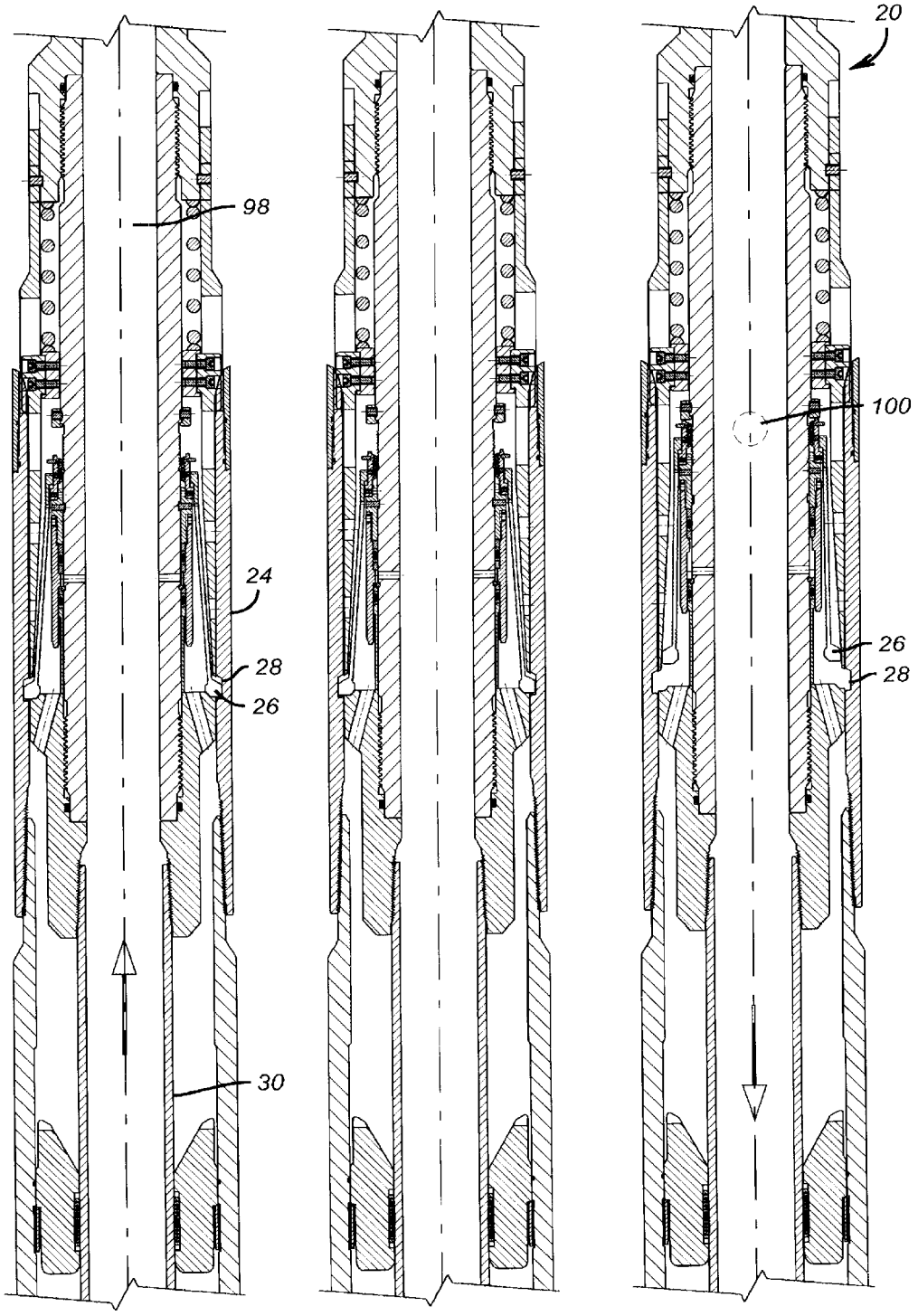
Figure 1C:
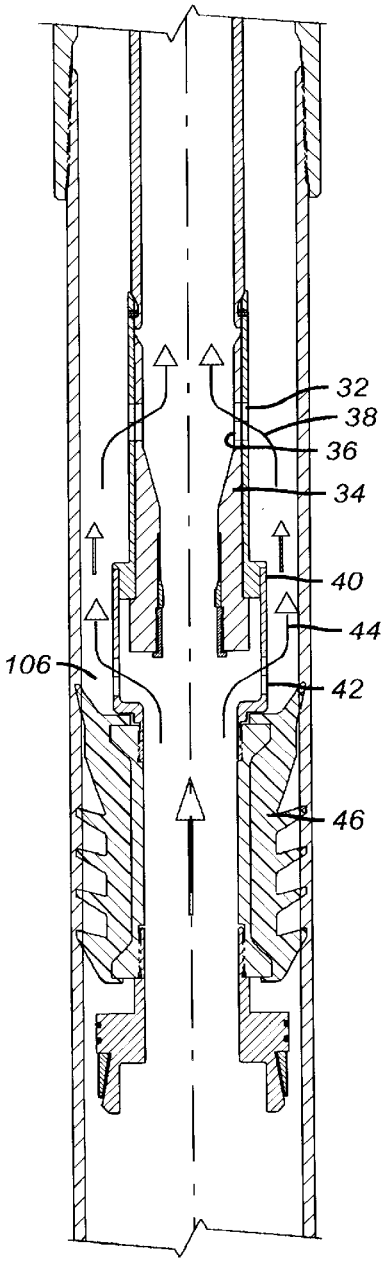
Figure 2C:
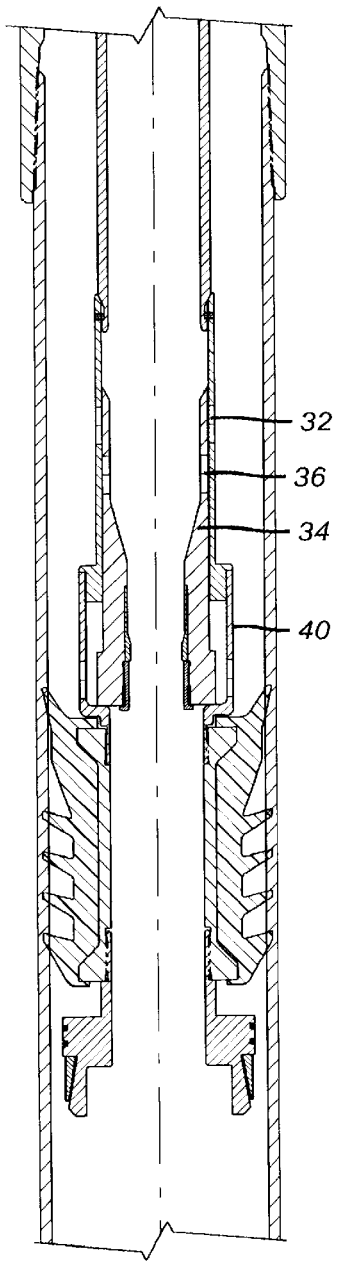
Figure 3C:
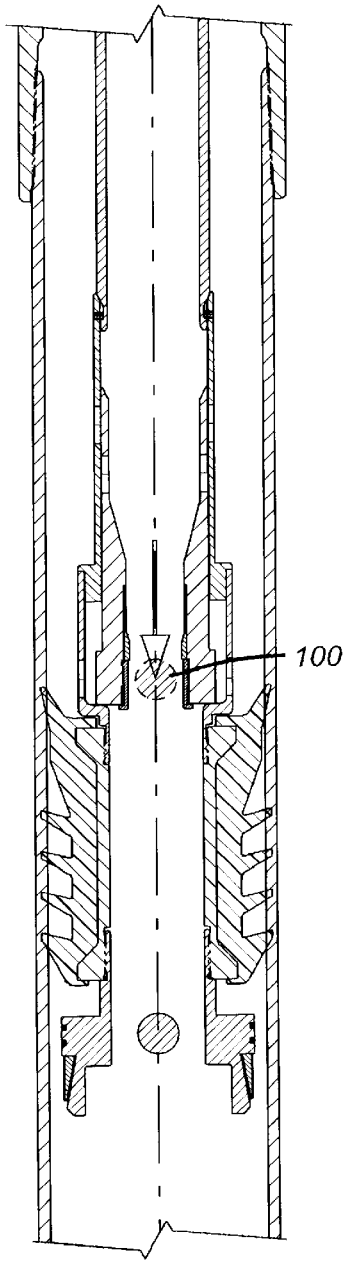
Figure 1D:
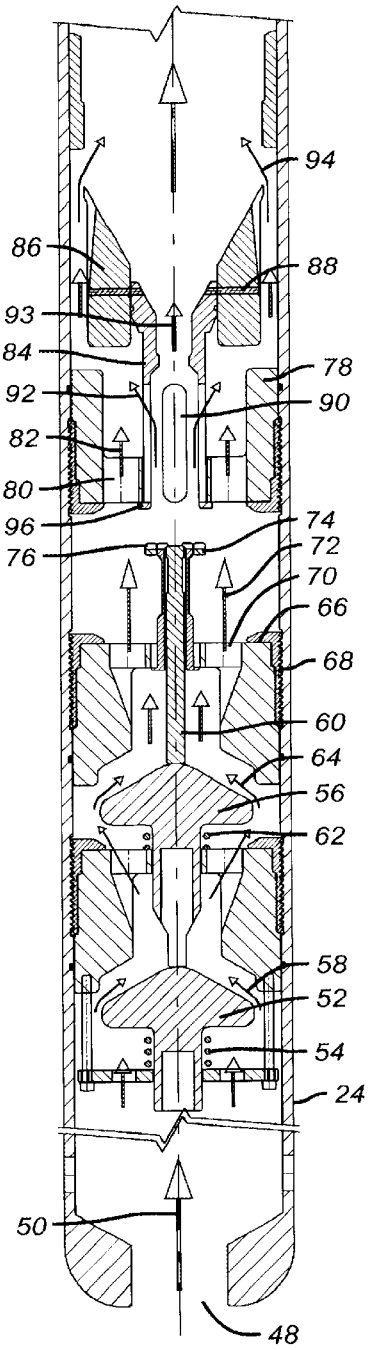
Figure 2D:
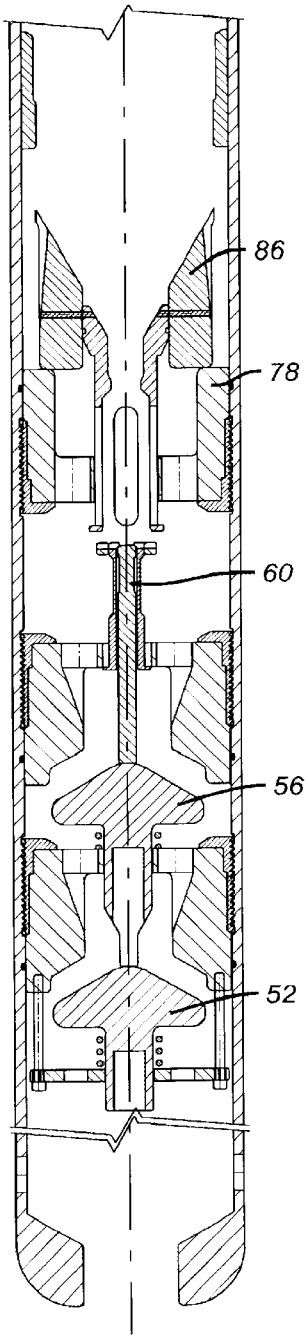

Referring now to FIG. 1*d*, the casing 24 has a bottom opening 48 through which flow enters when the casing 24 is advanced downhole as shown by arrow 50. A lower check valve 52 is biased upwardly by spring 54. In the run in position of FIG. 1*d*, spring 54 is compressed because the upper check valve 56 is bearing down on check valve 52 to allow flow around check valve 52 as depicted by arrow 58. A rod 60 keeps spring 62 compressed allowing flow around check valve 56 as represented by arrows 64.

A spider 66 is threaded to the casing 24 at thread 68 and has a series of flow ports 70 to allow flow therethrough as represented by arrows 72. A series of collets 74 extending from spider 66 retain rod 60 and keep it from moving uphole in response to a bias force from spring 62. A lock ring 76 retains the collets 74 in a run in position shown in FIG. 1*d*.

Further uphole, a spider or fixed component 78 is secured by threads to the casing 24 and has a series of ports 80 to allow flow as represented by arrows 82. In the middle of spider 78 is floating sleeve 84 to which is connected a cone 86 with a shear pin 88. Floating sleeve or moveable component 84 has a series of slots 90 which permit flow therethrough as shown by arrows 92. Floating sleeve 84 further permits flow through a central bore represented by arrow 93. The flow represented by arrow 93 goes through an opening in the cone 86 as shown in FIG. 1*d*. Cone 86 has a peripheral clearance inside casing 24 to allow flow to go around it on the outside as shown by arrows 94. Floating sleeve 84 has a lower flange 96 which is sized to contact the lock ring 76 below it to ultimately release the collets 74 to allow the rod 60 to move uphole as will be described later.

Accordingly, in the run in position flow enters casing 24 as represented by arrow 50. Flow continues around check valve 52 which is in the open position as represented by arrows 58. Flow continues around check valve 56 as represented by arrow 64. Thereafter flow goes through the spider 66 represented by arrow 72 and then through the spider 78 as represented by arrows 82 or alternatively through the floating sleeve 84 through its slots 90 as represented by arrows 92 or through a central passage in the floating sleeve 84 as represented by arrow 93. Thereafter flow is through the wiper plug 46 (FIG. 1*c*) as represented by arrows 44 and back into the seal extension 30 as represented by arrows 38 upwardly through bore 98 (FIG. 1*b*) and out the port 16 (FIG. 1*a*) as represented by arrow 18 to the top of the hole.

The run in position having been described, the further operation of the tool as depicted in FIGS. 2*a–d* will now be explained. In the position shown in FIG. 2, downhole movement of the casing 24 has ceased as it has reached its appropriate depth. Comparing FIGS. 2*c* and 1*c*, it can be seen that the float sleeve 34 has shifted downwardly to its lowermost position supported by receptacle 40 which has in effect closed off ports 32 in receptacle 40 because ports 36 are no longer in alignment with ports 32. Looking further down and comparing FIGS. 2*d* and 1*d*, it can be seen that the assembly of the cone 86 and float sleeve 84 have moved downwardly in tandem such that spider 78 now supports cone 86. In this position, the rod 60 has retained its position from FIG. 1*d* and accordingly the check valve 56 and 52 are still in the open position and off their respective seats even though there is no flow through them because of cessation of downhole movement of the casing 24. The path represented by arrow 94 is now blocked by the cone 86 resting on spider 78.

Referring now to FIGS. 3*a–d*, a ball 100 lands in the seat 102 to allow downward shifting of the sliding sleeve 12 so as to close the port 16. Further pressure build up drives the ball 100 past the seat 102. The downward movement of ball 100 can be followed by comparing FIGS. 3*a–d*. Ultimately, the ball 100 lands in a seat 104 shown in FIG. 3*d* as part of the float sleeve 84. At this time the casing 24 is essentially sealed internally. Application of pressure on ball 100 drives the float sleeve 84 downwardly until its flange 96 contacts lock ring 76 which drives lock ring 76 downwardly and unlocks rod 60 for uphole movement because the collets 74 can move outwardly with ring 76 displaced. When rod 60 is able to move upwardly, the springs 54 and 62 expand as check valves 52 and 56 move to their closed positions shown in FIG. 3*d*. The assembly shown in FIGS. 3*a–d* is now ready for cementing.

Figure 3D:
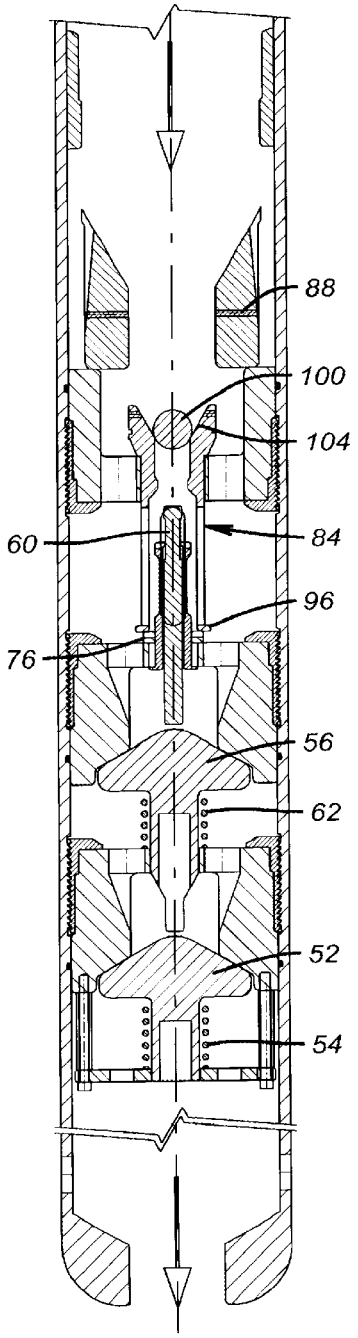

It should be noted that with ball 100 on seat 104 as shown in FIG. 3*d*, before pins 90 are sheared, additional equipment can be provided to the assembly shown in FIGS. 3*a–d* and actuated by pressure. For example, a pressure to set hydraulic hanger can be applied to the casing 24 to hang it. The shear pin 90, which is shown in FIG. 3*d* in the broken position, can be sized appropriately to allow multiple levels of pressure build up to operate additional auxiliary pressure actuated equipment. One such item is a hydraulic hanger which can be mounted below the running tool 20. Additionally, a higher level of pressure build up can be used to release the collets 26 from groove 28 for a release of running tool 20 as shown in FIG. 3*b*.

Those skilled in the art will appreciate that a redundancy in check valves is provided in the preferred embodiment. However, more or fewer check valves can be provided without departing from the invention. It is important to be able to close off the casing 24 after it is run into position. The redundancy of check valves 52 and 56 ensures that such a closure will take place.

Those skilled in the art can now appreciate that the design of the present invention allows for greater cross sectional flow areas while running in the casing 24. This allows for far greater running rates for the casing and saves rig time. By using the deformable ball seats of known design, the size of the ball 100 can be reduced down to as little as 1.5 inches to prevent problems of access through uphole equipment. Referring to FIG. 1*d*, a greater cross sectional flow area is made available by virtue of a combination of ports 80, slots 90 and a central passage represented by arrow 93 through the float sleeve 84. Accordingly, for casing size in the order of 9⅝ to 13⅜ inches, an open area of 10 square inches and higher can be achieved through this zone. Similarly, up above where flow areas through sleeves such as 34 normally configured with wiper plug 46 can also present a flow restricting area. The floating design of float sleeve 34 in combination with passages 42 also allows an increase in flow area in this section of the down hole assembly of comparable open area to that shown below in FIG. 1*d*. Thus, for example, for standard wall casing of approximately 9⅝ inch diameter, the relative open area of approximately 10 square inches or greater can be compared to the total available internal area in the casing 24 of approximately 59 square inches. Accordingly, open areas of about 10 square inches or 15 percent or greater open area as compared to the prior art bottlenecks which have been in the order of 3 to 4 square inches can be achieved with the design of the present invention. The accompanying increase in speed of running in the assembly can be readily appreciated.

Additional flow ports through the cone 86 can be provided, if desired.

The reconfiguration of receptacle 40 allows a greater open area in the region of wiper plug 46 by letting flow into the annulus 106 around inner mandrel 30.

The above description of the preferred embodiment is merely illustrative and those skilled in the art will appreciate that modification of the preferred design with regard to number, size, physical placement and movement of the parts can be undertaken without departing from the invention whose scope is fully determined by the claims below.

I claim:

1. An apparatus to provide improved flow area through a tubular, such as casing, having a lower end and being run into a wellbore, comprising:

a first valve in said tubular, said first valve selectively closeable to prevent flow into the lower end of the tubular;

an actuator in the tubular selectively engageable to said first valve, said actuator having a flowpath therethrough which, when said first valve is in an open position represents a minimum flow area through the tubular, said minimum flow area exceeds about 4 square inches.

2. The apparatus of claim 1, wherein:

said minimum flow area approximates about 10 square inches.

3. The apparatus of claim 1, wherein:

said first valve comprises a lock to hold it in an open position;

said actuator selectively defeating said lock to allow said first valve to move to a closed position.

4. The apparatus of claim 3, wherein:

said first valve is biased toward its closed position, said valve is held open against said bias by a collet retained to a fixed support in the tubular;

said actuator comprising a moveable component which selectively frees said collet from said fixed support.

5. The apparatus of claim 4, wherein:

said moveable component comprises a floating sleeve with a seat at an upper end thereof, said sleeve movable to expose additional passages laterally therethrough when the tubular is advanced into the wellbore;

said seat accepting an object dropped downhole to land on said seat to allow said sleeve to be displaced with fluid pressure;

said collet is retained by a ring which is displaced by said sleeve when said sleeve is moved by fluid pressure with an object on said seat.

6. The apparatus of claim 5, wherein:

said actuator comprises a stationary component having a flow opening and supported by the tubular, said floating sleeve is supported by said stationary component, said floating sleeve supports a cone releasably retained thereto, said cone formed to direct said object to said seat and to minimize openings through said stationary component when said cone comes in contact with said stationary component.

7. The apparatus of claim 1, further comprising:

a wiper plug assembly having a second minimum flow area that at least equals said minimum flow area through said actuator.

8. The apparatus of claim 7, further comprising:

a floating sleeve mounted to a receptacle on said wiper plug, said floating sleeve moves responsive to advancement of the tubular to expose ports in said receptacle which provide a bypass path around an internal passage in said sleeve, said bypass path comprising in part said second minimum flow area.

9. The apparatus of claim 8, wherein:

said receptacle has at least one lateral port, said floating sleeve has at least one lateral port, whereupon advancement of said tubular said ports in said floating sleeve and said receptacle line up, said floating sleeve having a lower end which is disposed away from lower ports on said receptacle to permit flow around said internal passage in said sleeve;

whereupon cessation of advancement of the tubular, said floating sleeve contacts said receptacle with its lower end to cover said lower ports while at the same time said lateral ports on said receptacle and floating sleeve are misaligned.

10. The apparatus of claim 1, further comprising:

a second valve mounted in the tubular adjacent said first valve;

a lock to hold said first valve open while said first valve holds said second valve open;

said first and second valves biased closed when said actuator unlocks said lock.

11. The apparatus of claim 10, wherein:

said lock comprises a rod extending from said first valve, said rod retained by at least one collet supported by the tubular against a stop, said collet releasably secured by a ring;

said actuator comprises a moveable component supported by a fixed component mounted to the tubular, said moveable component comprising a sleeve having a through passage and when said moveable component is forced against said ring, it moves said ring to allow said first and second valves to be biased closed.

12. The apparatus of claim 11, wherein:

said fixed component comprising openings;

said moveable component comprising a seat adjacent its upper end and a cone releasably connected adjacent said upper end;

said cone engaging said fixed component when the tubular is not being advanced to block said openings in said fixed component.

13. The apparatus of claim 12, wherein:

said cone guides an object to land on and obstruct said through passage when landing on said seat;

said cone is shear pinned to said moveable component until said moveable component is propelled to displace said ring to let said first and second valves be biased to close.

14. The apparatus of claim 11, further comprising:

a running tool with an internal mandrel extending into a receptacle supported by a wiper plug disposed in the tubular, a moveable sleeve in said receptacle with a through passage, said sleeve and receptacle defining a bypass flowpath around said through passage which is held open by advancing the tubular.

15. An apparatus to provide improved flow area through a tubular, such as casing, being run into a wellbore, comprising:

a first valve in said tubular, said first valve selectively closeable to prevent flow into the tubular;

an actuator in the tubular selectively engageable to said first valve, said actuator having a flowpath therethrough which, when said first valve is in an open position represents a minimum flow area through the tubular, said minimum flow area exceeds about 4 square inches;

said actuator comprises a stationary component mounted to the tubular and a moveable component supported by said stationary component;

said moveable component displaceable by fluid passing through the tubular as it is advanced downhole to hold open at least one passage therethrough.

16. The apparatus of claim 15, wherein:

said stationary component has at least one opening therethrough;

said moveable component comprises a sleeve having a through passage and at least one lateral opening defining another flowpath in the tubular.

17. The apparatus of claim 16, further comprising:

a ported sub with a sliding sleeve having a first seat, said port in said sub being open for run in for flow induced by advancing the tubular;

said first seat accepting an object to obstruct it so that said sleeve can be displaced to close said ported sub;

said object can be propelled through said first seat to land on a second seat on said movable component to block said through passage thereon.

18. The apparatus of claim 17, wherein:

said first valve comprises a lock to hold it in an open position against a bias toward a closed position;

said movable component, when propelled by pressure against said object on said second seat, unlocks said lock to let said first valve close.

19. The apparatus of claim 18, wherein:

said moveable component lands on said stationary component when the tubular is not being advanced to block said opening in said stationary component whereupon when said object lands on said second seat the flow area through the tubular is minimized to allow built up pressure to propel said moveable component to unlock said first valve.

* * * * *